US010220391B2

(12) United States Patent
Maas

(10) Patent No.: US 10,220,391 B2
(45) Date of Patent: Mar. 5, 2019

(54) ASSEMBLY FOR STORING AND MIXING TWO SUBSTANCES

(71) Applicant: Eurotrol B.V., Ede (NL)

(72) Inventor: Bartholomeus Henricus Antonius Maas, Ede (NL)

(73) Assignee: Eurotrol B.V., Ede (NL)

( * ) Notice: Subject to any disclaimer, the term of this patent is extended or adjusted under 35 U.S.C. 154(b) by 0 days.

(21) Appl. No.: 15/640,646

(22) Filed: Jul. 3, 2017

(65) Prior Publication Data

US 2017/0320060 A1 Nov. 9, 2017

Related U.S. Application Data

(62) Division of application No. 14/774,345, filed as application No. PCT/NL2014/050152 on Mar. 11, 2014, now Pat. No. 9,731,294.

(Continued)

(30) Foreign Application Priority Data

Mar. 11, 2013 (NL) ..... 2010423

(51) Int. Cl.

| | |
|---|---|
| ***B01L 3/00*** | (2006.01) |
| ***B01L 3/02*** | (2006.01) |
| ***B65D 25/08*** | (2006.01) |

(52) U.S. Cl.

CPC ..... *B01L 3/527* (2013.01); *B01L 3/0272* (2013.01); *B01L 3/502* (2013.01); *B65D 25/08* (2013.01);

(Continued)

(58) Field of Classification Search

CPC ..... B01L 3/527; B01L 3/0272; B01L 3/502; B01L 2300/123; B01L 2300/043; B01L 2300/042; B65D 25/08

(Continued)

(56) References Cited

U.S. PATENT DOCUMENTS 5,088,627 A 2/1992 Musel
5,474,209 A * 12/1995 Vallet Mas ..... B65D 51/285 206/219

(Continued)

FOREIGN PATENT DOCUMENTS

AT 413 095 11/2005
EP 0 315 440 5/1989

(Continued)

OTHER PUBLICATIONS

International Search Report dated May 12, 2014, corresponding to PCT/NL2014/050142.

*Primary Examiner* — Jill A Warden
*Assistant Examiner* — Jacqueline Brazin
(74) *Attorney, Agent, or Firm* — N.V. Nederlandsch Octrooibureau; Catherine A. Shultz; Lindsey A. Auerbach

(57) ABSTRACT

Storage assembly for two substances to be mixed prior to use, comprising a closable dropper tip (3). A first storage chamber (7) is formed by the closable dropper tip (3) and a first container part (2, 4), the first container part (2, 4) being provided with at least one aperture (43). A second storage chamber (8) is formed by a second container part (5) which comprises an open end part (52, 53) that closes off the at least one aperture (43) in a first operational position. The first and second container part (2, 4; 5, 6) are moveable with respect to each other, and are in fluid communication through the at least one aperture (43) in a second operational position wherein the total flow surface area of the at least one aperture (43) is at least equal to a cross sectional area of the first container part (2, 4).

14 Claims, 5 Drawing Sheets

Related U.S. Application Data

(60) Provisional application No. 61/775,821, filed on Mar. 11, 2013.

(52) U.S. Cl.
CPC ..... *B01L 2200/16* (2013.01); *B01L 2300/042* (2013.01); *B01L 2300/047* (2013.01); *B01L 2300/087* (2013.01); *B01L 2300/0832* (2013.01); *B01L 2400/0683* (2013.01); *B65D 2101/0015* (2013.01)

(58) Field of Classification Search
USPC ..... 422/559
See application file for complete search history.

(56) References Cited

U.S. PATENT DOCUMENTS

| | | | | |
|---|---|---|---|---|
| 5,593,028 | A * | 1/1997 | Haber | A61J 1/2093 206/219 |
| 2002/0104848 | A1 * | 8/2002 | Burrows | A61J 7/0481 221/1 |
| 2009/0255953 | A1 | 10/2009 | May et al. | |

FOREIGN PATENT DOCUMENTS

| | | |
|---|---|---|
| EP | 0 577 200 | 1/1994 |
| EP | 1 931 574 | 12/2009 |

* cited by examiner

ASSEMBLY FOR STORING AND MIXING TWO SUBSTANCES

FIELD OF THE INVENTION

The present invention relates to a storage assembly for keeping two substances which are intended to be mixed just prior to use, separated during storage. The storage assembly comprises a closable dropper tip allowing to provide droplets of the eventually mixed substances.

PRIOR ART

In In Vitro Diagnostics (IVD), the trend is to move tests from hospital central lab to near patient testing (Point of Care Testing, POCT). Personnel carrying out the tests in the POCT environment have very limited technical or laboratory background for which easy and simple tests need to be developed, also in the field of quality control (QC).

Also, there is a trend that IVD tests (mainly for POCT) use less sample material (100 μL or less). Lyophilized materials require reconstitution prior to use. Typically, reconstitution is to be done through pipetting an exact amount of pure water. At the POC sites, pipette and water of the appropriate purity are not commonplace.

To overcome this, the prior art publication EP-A-1 931 574 of present applicant, provides for a storage solution with two chambers, one for the lyophilized material and another for the reconstitution liquid. Applications can also include liquid-liquid solutions. This prior art assembly has the disadvantage that after reconstitution it is not possible to dose an amount of sample directly from the assembly. Instead it is necessary to apply a separate syringe in order to transfer the mixed liquid, or an aspiration needle from the IVD instrument, or any separate sampling device. The IVD tests commonly require only drops of blood.

Austrian patent publication AT-B-413 095 discloses a container having a closable dropper applicator for storing, mixing and applying two substances. A first and second chamber are provided for keeping the substances separated prior to actual use. A rotating actuation is needed for activation, which rotation can be reversed. As a result, it is not clear whether the container has been tampered with before actual use. The arrangement for the activation also results in contamination of the substances and proper mixing is hampered by the geometry of the container.

European patent application EP-A-0 577 200 discloses a container with a dropper applicator (with screw cap), having two container parts. A separating wall between the container parts can be pierced by rotating the top part in order to allow the contents of the container parts to mix. It is noted that using a piercing element, parts of the separating wall can end up in the mixed substance causing contamination and hampering proper mixing.

American patent publication U.S. Pat. No. 5,088,627 discloses a container having a dropper applicator, and two container parts. By rotating the top part, a fluid connection can be provided between the two container parts allowing mixing of the substances contained therein. However, the shape and construction of the container allow only a very limited flow for mixing, and a lot of dead space is present hampering proper mixing and application of the mixed substance.

European patent application EP-A-0 315 440 discloses a container having a dropper applicator, wherein a valve arrangement closing off a bottom container part is pushed upward to allow the contents thereof to flow into an upper container part. The dead spaces present in this design will necessitate fierce shaking for obtaining a proper mixing.

SUMMARY OF THE INVENTION

The present invention seeks to provide an improved version of an assembly which can be used in e.g. IVD tests, allowing two substances to be kept strictly apart during storage, and to be mixed just prior to actual use.

According to the present invention, a storage assembly according to the preamble defined above is provided, further comprising a first storage chamber formed by the closable dropper tip and a first container part, the first container part being provided with at least one aperture, a second storage chamber formed by a second container part, the second container part comprising an open end part, which closes off the at least one aperture in a first operational position, wherein the first container part and second container part are moveable with respect to each other, and are in fluid communication with each other through the at least one aperture in a second operational position, wherein the total flow surface area of the at least one aperture is at least equal to a cross sectional area of the first container part. The two separate chambers allow for strictly separate long-term storage of two different substances/liquids, and the further construction details provide a very easy and convenient way to activate the product by allowing the two substances to mix. The dropper-tip allows dosing droplets of the reconstituted/mixed product directly from the storage assembly without usage of any other sampling device. Furthermore, after activation of the storage assembly, no flow resistance occurs which allows a very gentle mixing, without violent motion of the substances to be mixed. Especially when needing to mix certain types of substances where only a low shear is permitted, such as in the case of substances comprising protein, albumin, whole blood cells or substances comprising a surfactant, only very gentle mixing is allowed. In a further embodiment, the first storage chamber and second storage chamber (in combination) provide a single, obstacle-free, inner space in the second operational position. The constructional features thus also provide an internal volume with no dead spaces, assuring that all of the substances are mixed properly, even when only gentle rocking of the storage assembly is performed for mixing.

In a further embodiment, the first container part comprises a canister of flexible material fluid-tightly connected to the closable dropper tip. This flexible part allows applying pressure by squeezing to allow dosing through the dropper-tip, but may also be used to promote mixing of the two substances.

The first container part comprises a tubular part of material fluid-tightly connected to the canister in a further embodiment, wherein the tubular part is provided with the at least one aperture. This allows easy manufacture of the parts and assembly of the parts of the storage assembly.

The second container part is slidably engaging an inner surface of the tubular part in a further embodiment. Furthermore, the second storage chamber has a first inner diameter d1 and the second container part comprises a constriction for a fluid tight connection of the second container part to the tubular part in the first operational position, the constriction having a second inner diameter d2 which is smaller than the first inner diameter d1 of the second storage chamber. This results in a simple construction and assembly of the various parts, including adding the two substances, and a simple operation by simply providing a mutual motion of the second container part with respect to the tubular part.

In a further embodiment the storage assembly comprises an activation blocking element, ensuring that the storage assembly is not inadvertently actuated. In one alternative, this is embodied as the tubular part comprising a rim having one or more extending tabs. This provides protection against undesired activation, and also provides a convenient thumb rest during actual use. In a further alternative embodiment, the storage assembly further comprises a removable blocking element between the tubular part and the second container part, in order to obtain a similar effect. In addition, the removable blocking element can act as an evidence that no tampering has occurred with the storage assembly.

The second container part comprises a closing cap in a further embodiment, which acts as a pressure element, and allows easy filling of second storage chamber. The closing cap is provided with a penetrable part in an even further embodiment, e.g. a part comprising a Luer head connector to use with standard syringe heads, or a part through which a needle can penetrate. This allows transferring the mixed product for further applications.

The closable dropper tip comprises a flip-cap element in a further embodiment for closing off the closable dropper tip. The storage assembly can thus be re-closed after usage through the flip-cap. The closable dropper tip may comprise a screw cap for closing off the closable dropper tip.

In a further embodiment one of the first and second storage chambers comprises a lyophilized material, and the other one of the first and second storage chambers comprises a reconstitution liquid. This makes the storage assembly specifically advantageous for use in Quality Control for In Vitro Diagnostics tests using lyophilized material. Alternatively, each of the first and second storage chambers comprises a different substance, which makes the storage assembly specifically usable for use in Quality Control for In Vitro Diagnostics tests using two substances.

SHORT DESCRIPTION OF DRAWINGS

The present invention will be discussed in further detail hereinafter based on a number of exemplary embodiments with reference to the drawings, wherein FIG. 1 shows a cross sectional view of an embodiment of the storage assembly according to the present invention in a first operational position.

Figure 5A:
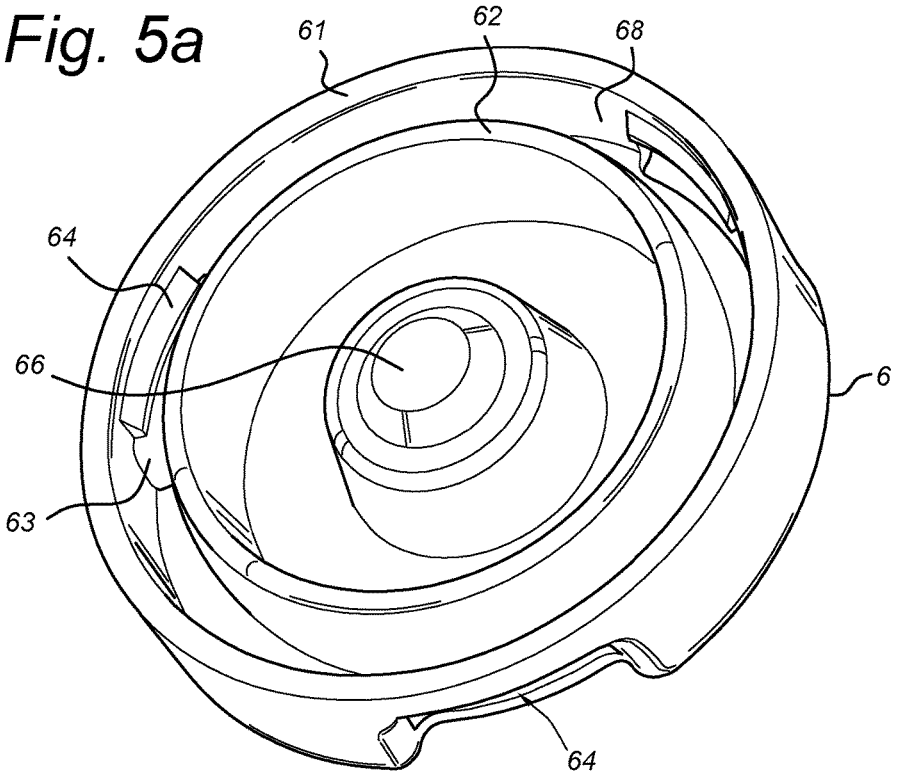

FIG. 5*a* shows a bottom view of a closing cap used in a storage assembly according to a further embodiment of the present invention.

Figure 5B:
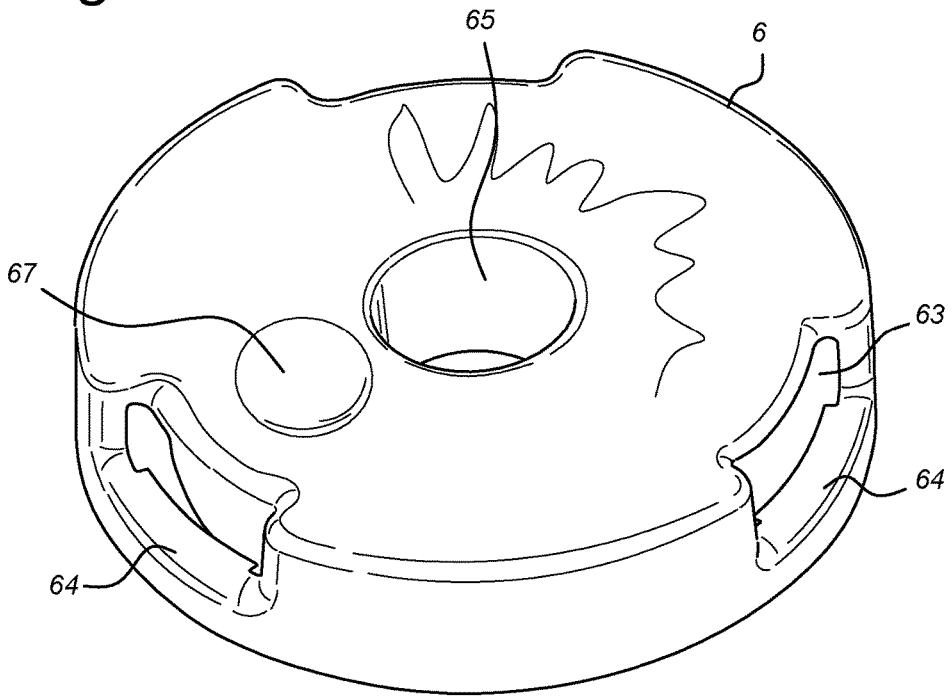

FIG. 5*b* shows a top view of the closing cap shown in FIG. 5*a*.

Figure 6:
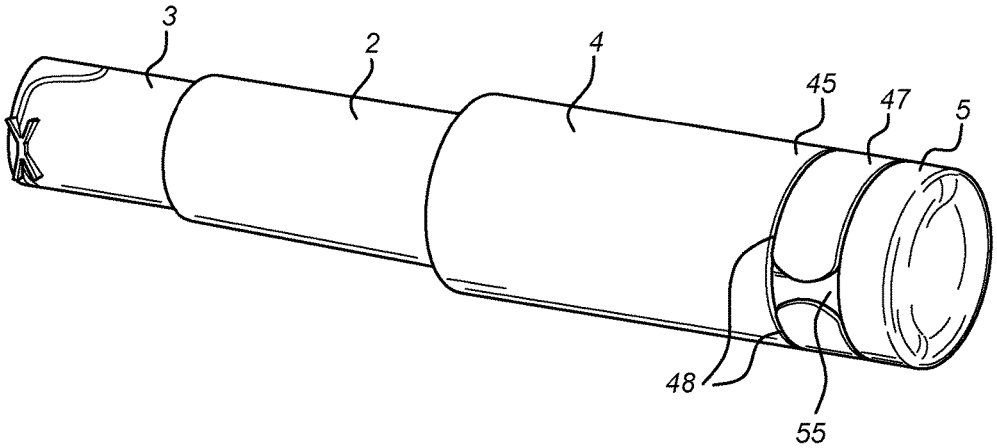

FIG. 6 shows a three dimensional view of a further embodiment of the storage assembly according to the present invention.

DETAILED DESCRIPTION OF EXEMPLARY EMBODIMENTS

The storage assembly according to the present invention embodiments is particularly suited for use in testing of In Vitro Diagnostics (IVD) equipment. In IVD, the trend is to move tests from hospital central lab to near patient testing (Point of Care Testing, POCT). Personnel carrying out the tests in the POCT environment have very limited technical or laboratory background for which easy and simple tests need to be developed, also in the field of quality control (QC). Also, there is a trend that IVD tests (mainly for POCT) use less sample material (100 μL or less).

Lyophilized (or freeze dried) materials require reconstitution prior to use. Typically, reconstitution is to be done through pipetting an exact amount of pure water. At the POC sites, pipette and water of the appropriate purity are not commonplace. Also in other tests, it is needed to mix two substances right before actual use (e.g. glucose tests, blood coagulation tests, hemoglobine tests, . . . ). The present invention embodiments can be used with benefit in all these types of tests.

In the present invention embodiments, in general terms two substances are kept separate prior to actual use, and are mixed just before actual use. The substances can be a variety of chemical substances, including but not limited to: a liquid; a gel; a powder; a gas; an oily substance; a tablet; a lyophilized material.

Figure 1:
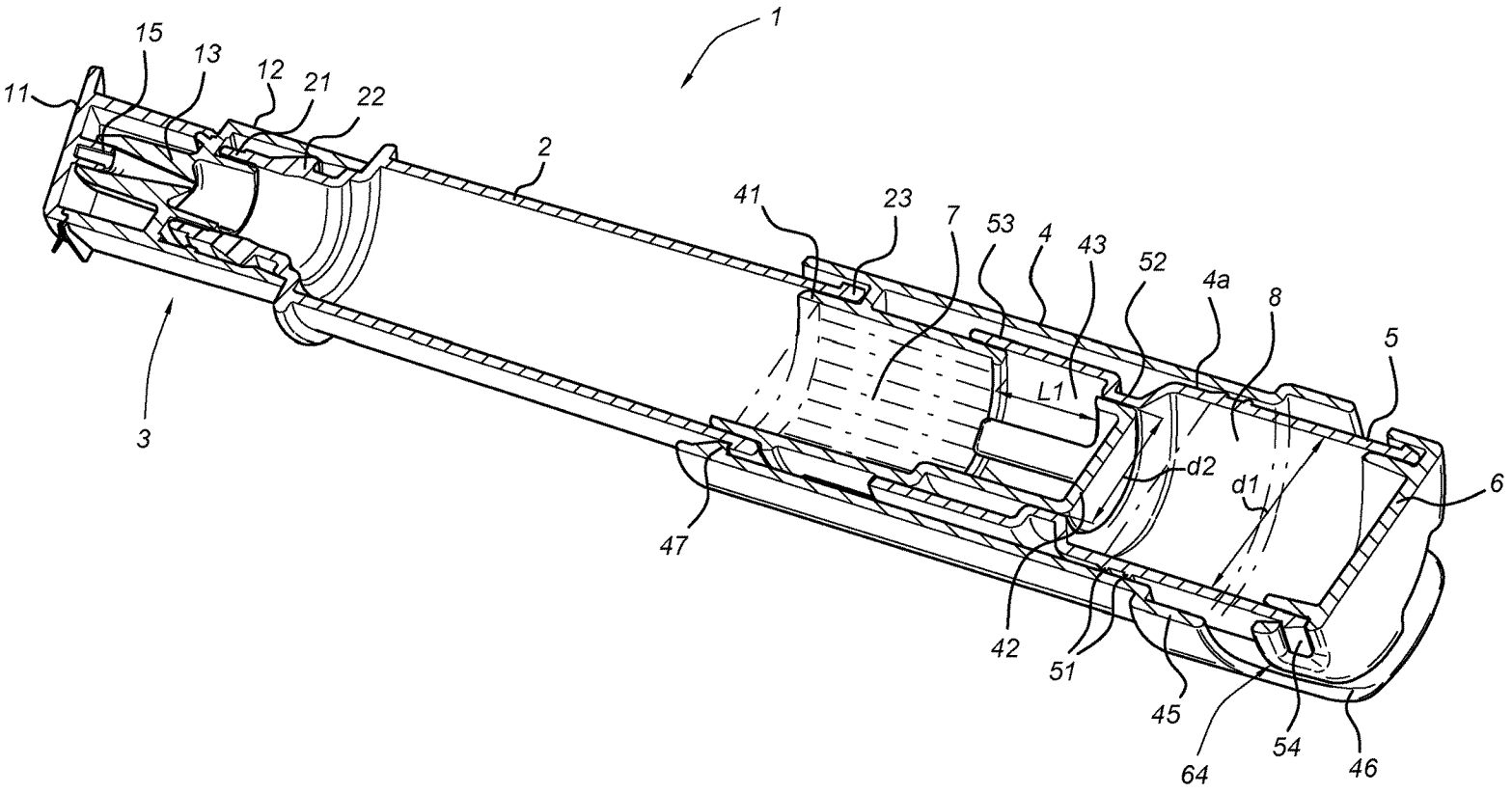

FIG. 1 shows a cross sectional view of an embodiment of a storage assembly 1 according to the present invention, comprising a closable dropper tip 3 and a first storage chamber 7 formed by a first container part 2, 4 and the closable dropper tip 3.

The closable dropper tip 3 is fluid-tightly connected to a canister 2 of the first container part 2, 4, using e.g. a rim 22 near a first end 21 of the canister 2 engaging an inner surface of a dropper tip body 12.

In the embodiment shown, the first container part 2, 4 further comprises a tubular part 4, fluid tightly coupled to a second end 23 of the canister 2, using a first end 41 of the tubular part 4 of which the outer diameter matches the inner diameter of the second end 23 of the canister 2. The coupling can be further enhanced using e.g. snap fit parts 47 shown in FIG. 1, which are dimensioned to engage a rim provided at the second end 23.

The tubular part 4 is provided with at least one aperture 43 extending over a part of the circumference of the tubular part 4 near an internal end surface 42 thereof. These apertures 43 are closed off in the first operational position of the assembly as shown in FIG. 1 by an open end part 53 being part of a second container part 5. E.g. as shown in the embodiment of FIG. 1, the inner diameter of the open end part 53 is matched to provide a fluid tight coupling to an outside diameter of the end of the tubular part 4.

Thus the first storage chamber 7 is formed by the inner surfaces of the canister 2, closable dropper tip 3, tubular part 4, and the open end part 53.

A second storage chamber 8 is formed by the inner surfaces of the second container part 5 and the outer surface of the second end 42 of the tubular part 4. In the embodiment shown the second container part 5 comprises an optional closing cap 6. The second container part 5 may be provided with one or more snap fit element 54 latching behind corresponding latch apertures 64 of the closing cap 6. In an alternative embodiment, the second container part 5 is provided as a single piece.

The first container part 2, 4 and second container part 5 are moveable with respect to each other. In the specific embodiment shown, this is made possible by the tubular part 4 comprising an inner surface 4*a* matching an outer surface of the second container part 5.

Figure 2:
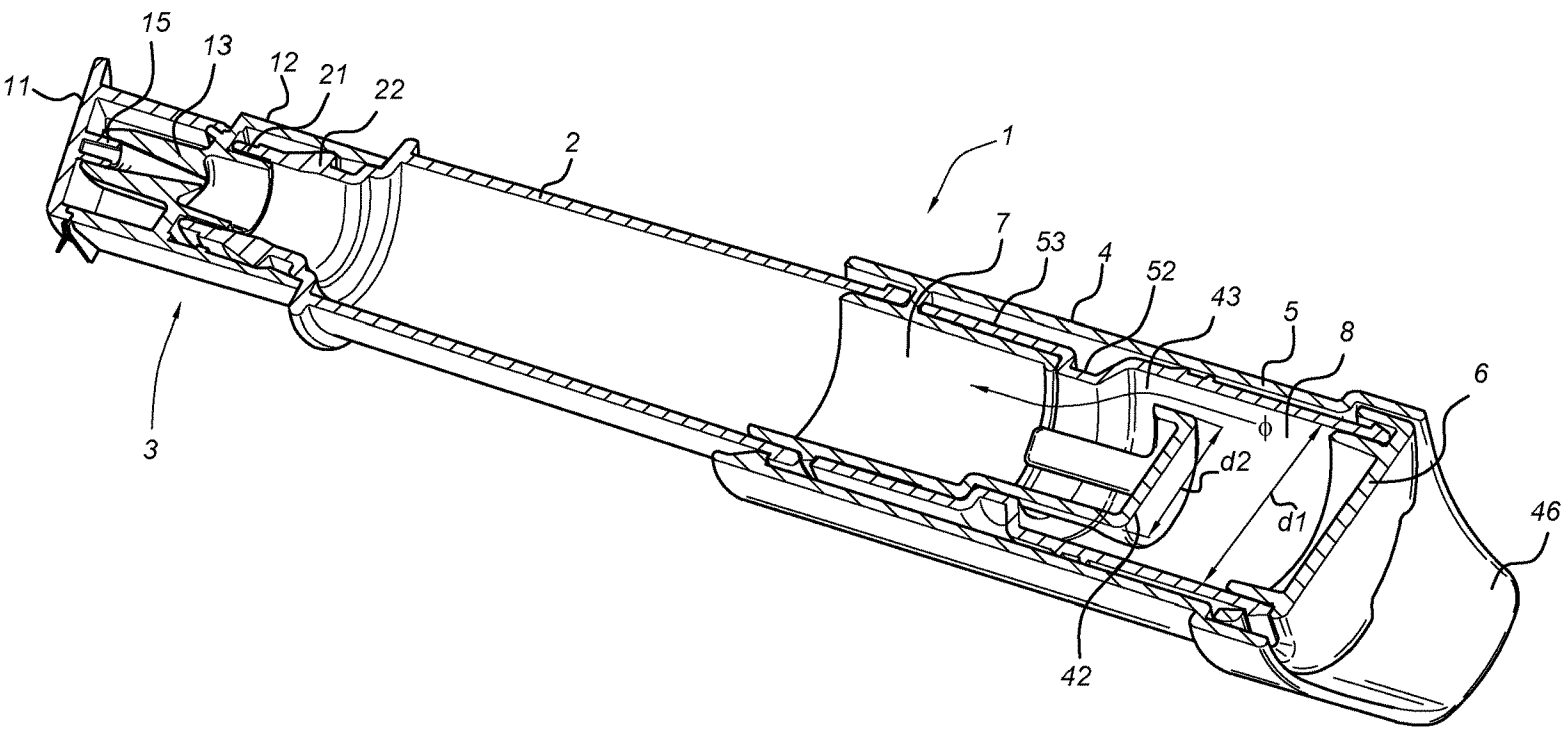
FIG. 2 shows a cross sectional view of the embodiment of the storage assembly of FIG. 1 in a second operational position.

When moving to the second operational position of the storage assembly (which is shown in the view of FIG. 2), the first chamber 7 and second chamber 8 are brought in fluid communication with each other through the at least one aperture 43, thus providing a very easy and convenient way to activate the product by allowing the two substances to mix. The at least one aperture 43 will be opened over almost the entire length L1 thereof (see FIG. 1), as a result of which the total flow surface area of the at least one aperture 43 is at least equal to a cross sectional area of the first container part 2, 4. As a result, after activation of the storage assembly 1, no flow resistance occurs which allows a very gentle mixing, without violent motion of the substances to be mixed. Especially when needing to mix certain types of substances where only a low shear is permitted, such as in the case of substances comprising protein, albumin, whole blood cells or substances comprising a surfactant, only very gentle mixing is allowed.

According to the present invention, the first and second chamber 7, 8 each store different substances, e.g. two substances in the first operational position of the storage assembly 1. No fluid flow exists between the first and second chamber 7, 8 nor can there be any mixing of any kind between the two stored substances by virtue of the open end part 52, 53 closing of the at least one aperture 43. The storage assembly 1 is therefore suitable for long-term storage of two different substances in the first operational position.

In the second operational position, the first and second chamber 7, 8 are in good fluid communication with each other, forming a single mixing chamber with the apertures 43, allowing a mixing of the two substances by gently rocking the storage assembly. The first and second chamber 7, 8 then provide a single, obstacle-free, inner space in the second operational position. Furthermore, when the first and second chamber 7, 8 each are filled with accurate amounts of substances, the mixing will include all of the amounts of substances, as no dead spaces or volumes exist in the combined, single mixing chamber. Thus also the eventually mixed substances will be of an accurate amount and composition. In other words, the constructional features thus also provide an internal volume with no dead spaces, assuring that all of the substances are mixed properly, even when only gentle rocking of the storage assembly 1 is performed for mixing.

In an embodiment, the container part 2, 4 comprises a canister 2 of flexible material fluid-tightly connected to the closable dropper tip 3, thereby preventing unwanted fluid leakage from the storage assembly 1. The flexible part of the canister 2 in combination with the closable dropper tip 3 allows for accurate delivery of the mixed substances, by squeezing the flexible part of the canister 2. As a secondary effect, the flexible part of the canister 2 further enables mixing of the two different substances through a squeezing motion of the canister 2, i.e. applying pressure by squeezing. In an embodiment, the first container part 2, 4 comprises a tubular part 4 of (rigid) material fluid-tightly connected to the canister 2, wherein the tubular part 4 is provided with the at least one aperture 43. In typical embodiments, the tubular part 4 further comprises a snap fit part 47 providing a rigid connection between the tubular part 4 and canister 2.

The first container part 2, 4 can thus be easily assembled using a modified standard canister 2 (of which the bottom is opened and provided with a rim at its second end 23) and the tubular part 4. As an alternative it would be conceivable to design the first container part 2, 4 as a single piece.

In other embodiments, the second container part 5 is of a rigid material, and/or is slidably engaging an inner surface 4*a* of the tubular part 4. One or more ridges 51 are provided and constructed in order to provide a tactile feedback to the user of the (transition between) the first and second operational position. In addition, the one or more ridges 51 can be constructed and used to minimize the friction between and provide guidance for the second container part 5 and the inner surface 4*a*.

In a further embodiment, the tubular part 4 comprises at an end opposite to the first end 41, a rim 45 having extending tabs 46 to prevent undesired activation of the moveable second container part 5, hence avoiding accidental or unwanted activation or mixing of the two different substances. The extending tabs 46 may also be formed to anatomically match a thumb, in order to provide a convenient thumb rest during use when holding the storage assembly 1 in the hand (and shaking it to mix the substances).

The material of the main parts of the storage assembly (first container part 2, 4, second container part 5 (and optional closing cap 6) , closable dropper tip 3) can be made of the same or of different materials. The materials for the storage assembly may comprise one or more of: a polymer material, a glass or glass like material, a metal material such as aluminum, etc. Parts of the storage assembly may be made of transparent material, e.g. the canister 2, or (viewing) windows provided in the tubular part 4. This allows viewing of the substances in the storage assembly, separated, during mixing and/or after mixing.

In the embodiment shown in FIG. 1, the second storage chamber 8 has a first inner diameter d1 and the second container part 5 comprises a constriction 52 for a fluid tight sealing of the second container part 5 to the tubular part 4 in the first operational position, the constriction 52 having a second inner diameter d2 which is smaller than the first inner diameter d1 of the second storage chamber 8. In the first operational position the constriction 52 is in a sliding and sealing engagement with the internal end surface 42, towards the at least one aperture 43.

In an embodiment, the closable dropper tip 3 of the storage assembly 1 may comprise a flip-cap element 11-13 for closing off the closable dropper tip 3. A hinged closing element 11 is attached to the dropper tip body 12 of closable dropper tip 3, and comprises an extending element 15 co-operating with an aperture part 13 of the closable dropper tip 3. In the opened position, the aperture part 13 is suitably formed to provide droplets at its end, in a manner known to the person skilled in the art.

In an alternative embodiment, the aperture part 13 may be provided as a separate element fitted to the first end 21 of the canister 2, and closable by a screw cap (not shown).

Both alternatives of the dropper tip 3 allow dosing droplets of the reconstituted/mixed product directly from the storage assembly 1 without usage of any other sampling device.

FIG. 2 shows an embodiment of the storage assembly 1 in the second operational position according to the present invention. In this embodiment it is clearly seen that the first and second chambers 7, 8 are now in fluid communication by means of the one or more apertures 43. The constriction 52 faces the one or more apertures 43 and a passageway is provided as the first inner diameter d1 is larger than an outer diameter d2 of the sealing dome 42.

Note that the first 2, 4 and second container part 5, 6 are moveable with respect to each other, so that the first and second chamber 7, 8 can be brought into fluid communication by pressing the closing cap 6. Doing so induces a fluid flow between the first and second chamber 7, 8 through the at least one aperture 43. In typical embodiments, the fluid stored in the second chamber 8 flows to the first chamber 7 when the storage assembly 1 changes from the first to the second operational position as indicted by the flow arrow Ø.

The storage assembly 1 of the present invention therefore enables a very easy and convenient way for mixing and activating the stored substances. The storage assembly 1 of the present invention is therefore a perfect packaging solution for QC materials in a POCT setting. It is accurate, easy to use for mixing materials and to dose the mixed substances using the canister 2 without any other sampling devices. Furthermore, the storage assembly 1 can be opened and closed by means of the closable dropper tip 3 for multiple testing.

Figure 3:
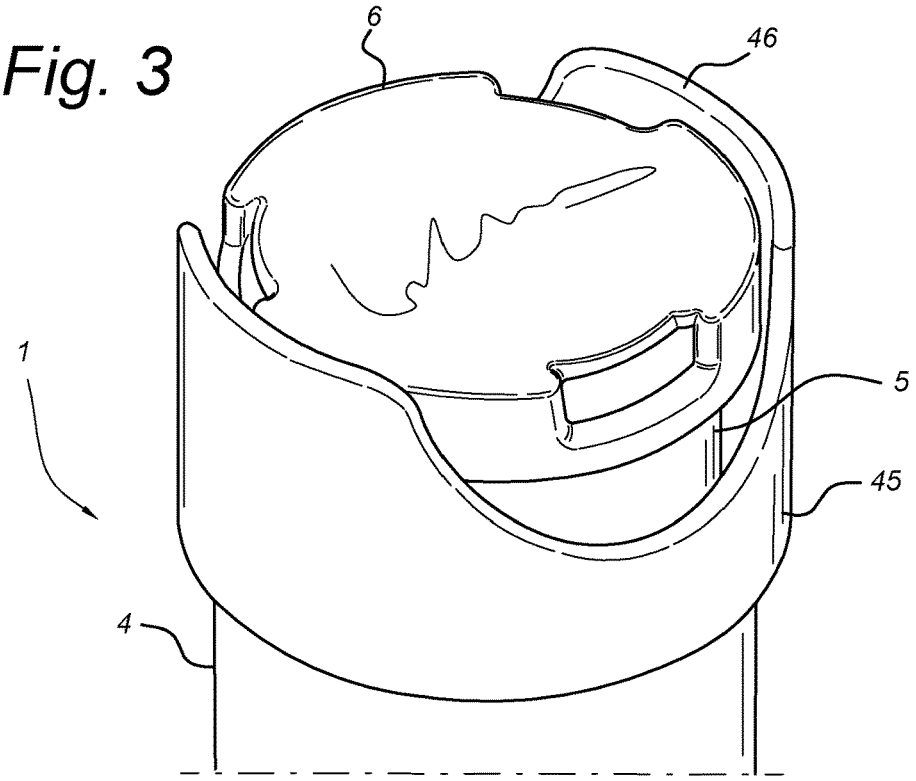
FIG. 3 shows a partial view of an embodiment of the storage assembly according to the present invention.
Figure 4:
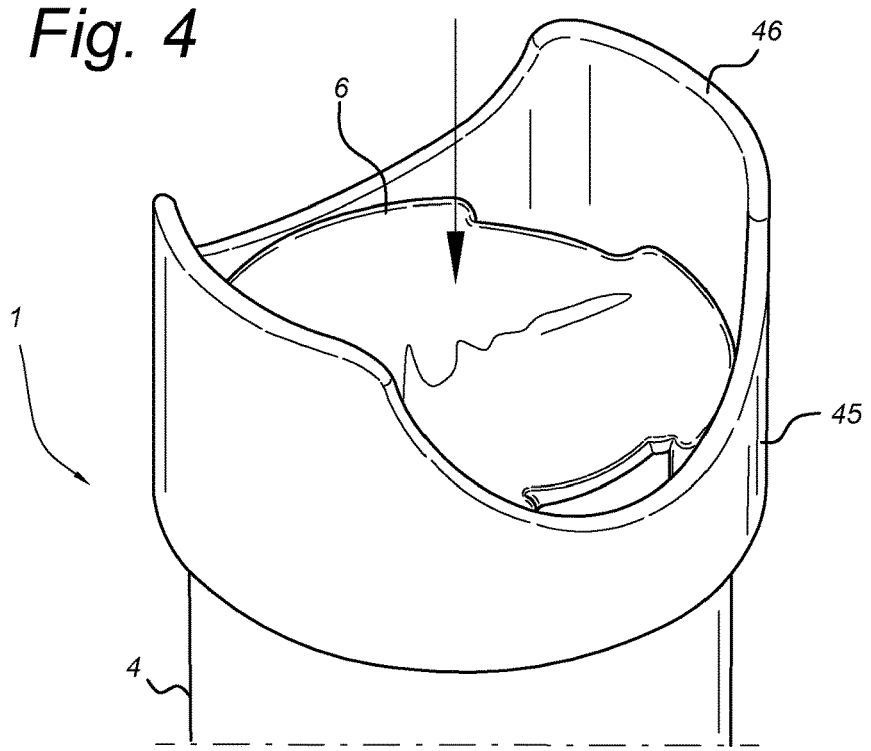
FIG. 4 shows the partial view of FIG. 3 in the second operational position.

The steps for using the storage assembly 1 for mixing the stored substances is further clarified by the embodiments shown in FIGS. 3 and 4, wherein FIG. 3 shows a perspective partial view of the first operational position of the storage assembly 1 and FIG. 4 shows a perspective partial view of the second operational position of the storage assembly 1. Depicted in FIG. 3, the extending tabs 46 of the rim 45 are flush with the closing cap 6 to prevent accidental actuation of the second container part 5, thereby minimizing unwanted activation or mixing of the two substances stored in the storage assembly 1. FIG. 4 clearly shows the depressed position of the closing cap 6 with respect to the extending tabs 46, which provide a convenient thumb rest and lateral support.

FIG. 6 shows a three dimensional view of a further embodiment of the storage assembly according to the present invention, in which the accidental actuation of the second container part 5 is prevented in an alternative manner, i.e. using a removable blocking element 47. For this, the storage assembly 1 further comprises a removable blocking element 47 between the tubular part 4 and the second container part 5. The removable blocking element 47 is attached to the rim 45 of the tubular part 4, and e.g. formed as integral part thereof, using breakable attachment bridges 48. The blocking element 47 abuts a rim on the second container part 5, e.g. formed by the cap 6, or integrally formed with the second container part 5. Right before use, the blocking element 47 can be removed by hand, allowing again the second container part 5 to move into the second operational position with respect to the first container part 2, 4. The blocking element 47 can also act as tamper proof evidence, any possible tampering with the storage assembly will be visible from an absence or damage to the blocking element 47 (e.g. the broken attachment bridges 48).

FIGS. 5*a* and 5*b* show a top and bottom view of further embodiments of the closing cap 6 respectively. In FIG. 5*a*, the closing cap 6 comprises two concentric ring portions 61, 62 forming an annular cavity 68 for receiving a rim 54 formed at the end of the second container part 5. The annular cavity 68 is adapted for providing a fluid-tight connection between the closing cap 6 and the second container part 5. In typical embodiments, the annular cavity 68 comprises a wedge-like geometry whereby the closing cap 6 is firmly fitted on the second container part 5 in a fluid-tight manner.

The closing cap 6 may furthermore be provided with apertures 63 and snap fit elements 64 co-operating with associated extensions on the rim 54 of the second container cap 5, in order to even better and more reliably secure the closing cap 6 to the second container part 5.

In an embodiment, the closing cap 6 is further provided with a cap fitting 65 which may be embodied as a cone shaped recess such as a female part of a Luer fitting, as shown in FIG. 5*b*. The bottom part 66 of such a Luer fitting (see FIG. 5*a*) can then be broken (e.g. using breaking lines around the bottom part 66), and the mixed substances can be taken out of the storage assembly 1. In yet another embodiment, the cap fitting 65 may be used to connect to a syringe to the second storage chamber 8, allowing to transfer the mixed substances for further applications. In an even further embodiment, the closing cap 6 may be provided with a local depression 67, where the local thinning of the material of the closing cap 6 e.g. allows to penetrate the closing cap 6 using a syringe needle. Even further embodiments may be contemplated when using two component molding. E.g. the local depression 67 or the bottom part 66 can then be formed of a rubber like material, allowing these parts to be penetrated by a needle. According to an advantageous embodiment of the storage assembly 1, one of the first and second storage chambers 7, 8 comprises a lyophilized (i.e. freeze-drying), and the other one of the first and second storage chambers 7, 8 comprises a reconstitution substance. This is specifically advantageous for use in Quality Control for In Vitro Diagnostics tests. Indeed, the storage assembly 1 of the present invention allows the reconstitution of lyophilized material without a separate sampling device for supplying a substance, such as a reconstitution liquid. The storage assembly 1 of the present invention therefore solves the problem of not having suitable reconstitution liquids and separate sampling devices at the POC sites. In another embodiment each of the first and second storage chambers 7, 8 comprises a different substance, which allows the local preparation of a mixed fluid for testing purposes, which is useful in numerous testing of analytical equipment.

Based on the detailed description of the storage assembly 1 above with reference to the embodiments shown in the drawings, the advantages of the present invention can be summarized as follows:

The storage assembly 1 comprises two separate chambers 7, 8 suitable for long-term separate storage of two different substances (e.g.) liquids without any mixing of any kind. The storage assembly 1 allows for a very easy and convenient way to activate the product needed for performing tests by mixing the stored substances, e.g. by rocking the storage assembly 1. This is possible as the apertures 43 are sufficiently large to combine the two separate chambers into a virtual single chamber. In addition, a flexible part of the storage assembly 1 may be used, e.g. the mixing of said substances is accomplished or enhanced by squeezing the flexible part 2 (the primary function of which is to act as dropper actuator). The storage assembly 1 allows for direct dosing of a mixed product by means of the closable dropper tip 3 without any other sampling devices, wherein the mixed product may be a reconstituted product. The storage assembly 1 can be opened and closed multiple times after usage through a flip-cap of the closable dropper tip 3. Screw caps can also be used. The storage assembly 1 may comprise one or more parts provided with a connector such as a Luer taper/fitting to use with syringe heads for transferring substances to or from the storage assembly 1.

Although the storage assembly 1 has been described with reference to a linear sliding second container part 5 along an inner surface of the first container part 4, it is readily conceivable that a passageway between the first and second storage chambers 7, 8 can be obtained through rotation of the second container part 5 with respect to the first container part 2, 4. That is, the first and second storage chambers 7, 8 may be fluidly connected through a rotation rather than a linear displacement. Other relative movements are also possible, such as push, pull, wind, screw, etc., and in both directions: e.g. for the embodiments described with reference to the drawings, an alternative would be to use a pulling motion from first to second operational position, instead of the pushing motion. Some of the alternative embodiments may also include a kinematic reversal of parts of the main elements described with reference to the embodiments above, providing a similar working of the storage assembly. E.g. the apertures 43 may be provided as part of the second container part 5, and the open end part 53 may be provided as part of the tubular part 4.

Also, more than two chambers 7, 8 could be provided by connecting multiple versions of the structural parts as described above in series. Activation can then be accomplished by providing a single mixing chamber at once for three or more substances kept separate before activation. Alternatively, combinations of mixing chambers may be formed consecutively, allowing e.g. to apply a first activation for mixing an intermediate substance (e.g. dissolving powder in a liquid), and consecutively after a second activation for obtaining a consecutive mixing chamber for mixing the intermediate substance with a third substance.

The present invention embodiments have been described above with reference to a number of exemplary embodiments as shown in the drawings. Modifications and alternative implementations of some parts or elements are possible, and are included in the scope of protection as defined in the appended claims.

The invention claimed is:

1. A storage assembly for two substances to be mixed prior to use, comprising a closable dropper tip connected to a first storage chamber, the first storage chamber formed and radially enclosed by a first container part, the first container part being provided with at least one aperture and a sealing part, a second storage chamber formed and radially enclosed by a second container part movable with respect to the first container part from a first to a second operational position, the second container part comprising an open end part and a constriction in the at least one aperture leading to the open end part of the second container part, the second container part configured to close off the at least one aperture in a first operational position by aligning the constriction with the sealing part in the first operational position, the sealing part having an outer circumference that is in direct contact to seal the constriction circumferentially in the first operational position, and allowing the first and second container parts to be in fluid communication with each other through the at least one aperture and constriction in the second operational position by moving the second container part such that the constriction no longer aligns with the sealing part and there is a space between at least one side of the outer circumference of the sealing part and an inner wall of the second storage chamber, wherein the cross-sectional area of the at least one aperture for flow through the at least one aperture is at least equal to a cross sectional area of the first container part, wherein the first container part comprises an immovable tubular part which is provided with the at least one aperture extending into the open end part of the second container part, and wherein the aperture in the first container part is located to connect the open end part of the second container part with the first container part in the second operational position, such that the first storage chamber and second storage chamber provide a single mixing chamber via the at least one aperture and constriction, providing an internal volume with no flow resistance.

2. The storage assembly according to claim 1, wherein the first container part comprises a canister of flexible material fluid-tightly connected to the closable dropper tip.

3. The storage assembly according to claim 2, wherein the first container part comprises a tubular part of material fluid-tightly connected to the canister, wherein the tubular part is provided with the at least one aperture.

4. The storage assembly according to claim 1, wherein the second container part is slidably engaging an inner surface of the tubular part.

5. The storage assembly according to claim 1, wherein the storage assembly comprises an activation blocking element at an outer circumference and end portion of the storage assembly to prevent undesired activation of the moveable second container part into the second operational position.

6. The storage assembly according to claim 5, wherein the activation blocking element comprises a rim having one or more extending tabs which extend beyond an end of the second container part to prevent accidental movement of the second container part.

7. The storage assembly according to claim 5, wherein the activation blocking element comprises a removable blocking element at an outer circumference between the tubular part and the second container part preventing movement into the second operational position.

8. The storage assembly according to claim 1, wherein the second container part comprises a closing cap.

9. The storage assembly according to claim 1, wherein the closing cap is provided with a penetrable part.

10. The storage assembly according to claim 1, wherein the closable dropper tip comprises a flip-cap element for closing off the closable dropper tip.

11. The storage assembly according to claim 1, wherein the closable dropper tip comprises a screw cap for closing off the closable dropper tip.

12. The storage assembly according to claim 1, wherein one of the first and second storage chambers comprises a lyophilized material, and the other one of the first and second storage chambers comprises a reconstitution liquid.

13. The storage assembly according to claim 1, wherein each of the first and second storage chambers comprises a different substance.

14. The storage assembly according to claim 1, wherein the sealing part is a rigid material.

* * * * *